US010525320B2

(12) United States Patent
Thomas et al.

(10) Patent No.: US 10,525,320 B2
(45) Date of Patent: Jan. 7, 2020

(54) PRACTICE DEVICE FOR IMPROVING VOLLEYBALL SKILLS

(71) Applicant: John Bert Thomas, Ocala, FL (US)

(72) Inventors: John Bert Thomas, Ocala, FL (US); Jeffrey L. Reavis, Ocala, FL (US)

(73) Assignee: John Bert Thomas, Ocala, FL (US)

( * ) Notice: Subject to any disclaimer, the term of this patent is extended or adjusted under 35 U.S.C. 154(b) by 52 days.

(21) Appl. No.: 15/399,782

(22) Filed: Jan. 6, 2017

(65) Prior Publication Data

US 2017/0197134 A1 Jul. 13, 2017

Related U.S. Application Data

(60) Provisional application No. 62/275,892, filed on Jan. 7, 2016.

(51) Int. Cl.

| | |
|---|---|
| ***A63B 69/00*** | (2006.01) |
| ***A63B 71/06*** | (2006.01) |
| ***A63B 63/00*** | (2006.01) |

(52) U.S. Cl.

CPC ..... *A63B 69/0095* (2013.01); *A63B 63/00* (2013.01); *A63B 69/0059* (2013.01); *A63B 71/0622* (2013.01); *A63B 2071/0625* (2013.01); *A63B 2071/0655* (2013.01); *A63B 2071/0694* (2013.01); *A63B 2207/02* (2013.01); *A63B 2209/10* (2013.01); *A63B 2225/50* (2013.01)

(58) Field of Classification Search

CPC ..... A63B 69/36; G06F 19/00

See application file for complete search history.

(56) References Cited

U.S. PATENT DOCUMENTS

| | | | | |
|---|---|---|---|---|
| 2,611,901 A | | 9/1952 | Neider | |
| 3,052,889 A | | 9/1962 | Furey | |
| 3,397,891 A | * | 8/1968 | Koch | A63B 60/08 473/298 |
| 3,491,373 A | | 1/1970 | Thomas, Jr. | |
| D255,505 S | | 6/1980 | Karolak | |

(Continued)

FOREIGN PATENT DOCUMENTS

WO WO 2003/011405 2/2003

OTHER PUBLICATIONS

Volleyball Passing Sleeves product information, [online, webpage, retrieved Feb. 10, 2013] from https://web.archive.org/web/20130210133537/http://tandemsport.com/store/products/Volleyball_Passing_Sleeves.html, pp. 1-6.

(Continued)

*Primary Examiner* — Eugene L Kim
*Assistant Examiner* — Christopher Glenn
(74) *Attorney, Agent, or Firm* — Saliwanchik, Lloyd & Eisenschenk

(57) ABSTRACT

A practice device with an integrated signal emitter that can provide a visual indicator. The practice device includes a dual-arm sleeve in which both arms can be inserted to form a platform for ball handling. The signal emitter integrated with the dual-arm sleeve provides a visual indicator that can effectively teach a player how their arm and body stance will affect the ball trajectory. When utilized with a target, the practice device helps a player learn how to achieve the correct arm and body stance from any location or position on the court in order to achieve the desired ball placement.

20 Claims, 10 Drawing Sheets

(56) References Cited

U.S. PATENT DOCUMENTS

| | | | | |
|---|---|---|---|---|
| 4,587,673 | A | 5/1986 | Boliard | |
| 4,665,565 | A | 5/1987 | Odom | |
| 5,028,050 | A | 7/1991 | Freyer | |
| 5,184,827 | A | 2/1993 | Suttle et al. | |
| 5,345,610 | A | 9/1994 | Belanger | |
| 6,006,358 | A | 12/1999 | Keating | |
| 6,016,103 | A * | 1/2000 | Leavitt | G08B 21/06 340/575 |
| 6,279,164 | B1 | 8/2001 | Martin | |
| 6,508,721 | B1 * | 1/2003 | Kriser | A41D 13/085 473/298 |
| D472,364 | S | 4/2003 | Riedler | |
| 6,725,465 | B2 | 4/2004 | Taylor | |
| 6,892,397 | B2 | 5/2005 | Raz et al. | |
| 7,854,668 | B2 | 12/2010 | Shelton | |
| 7,904,967 | B1 | 3/2011 | Cummings | |
| 8,075,427 | B2 | 12/2011 | Millsap | |
| 8,292,760 | B2 | 10/2012 | Johnson | |
| 8,357,043 | B2 * | 1/2013 | Mukasa | A63F 13/00 273/138.2 |
| 8,360,904 | B2 | 1/2013 | Oleson et al. | |
| 9,301,562 | B1 * | 4/2016 | Chen | A41D 19/0027 |
| 2003/0130074 | A1 | 7/2003 | Petroskey | |
| 2007/0167205 | A1 * | 7/2007 | Whitfield | G07F 17/32 463/11 |
| 2009/0239674 | A1 * | 9/2009 | Huffman | A63B 69/0059 473/213 |
| 2009/0253538 | A1 | 10/2009 | True | |
| 2010/0229280 | A1 | 9/2010 | Robinson | |
| 2010/0255921 | A1 | 10/2010 | Holdridge et al. | |
| 2015/0089713 | A1 | 4/2015 | Gonzalez | |
| 2015/0099593 | A1 * | 4/2015 | Fox | A63B 69/3667 473/266 |
| 2015/0309535 | A1 * | 10/2015 | Connor | G06F 1/163 361/679.03 |

OTHER PUBLICATIONS

Men Women Winter Warm Couple Lovers Conjoined Gloves Christmas Gift Polar Fleece Novelty 1 Set product information, [online, webpage, retrieved Nov. 5, 2015] from: http: /goo.gl/2JF4jw, p. 1.

Pass Rite Training Tool by Tandem Sport product information, [online, webpage, retrieved Feb. 10, 2013] https://web.archive.org/web/20130210094730/http://tandemsport.com/store/oroducts/Pass_Rite_Training_Tool_by_Tandem_Sport.html, pp. 1-6.

* cited by examiner

PRACTICE DEVICE FOR IMPROVING VOLLEYBALL SKILLS

CROSS-REFERENCE TO A RELATED APPLICATION

This application claims the benefit of U.S. Provisional Application Ser. No. 62/275,892, filed Jan. 7, 2016, the disclosure of which is hereby incorporated by reference in its entirety, including all figures, tables and drawings.

BACKGROUND OF INVENTION

Volleyball is a sport in which the playing ball is manipulated entirely with the hands and arms during a game. The position and placement of the hands and arms when making contact with the ball are critical to ensuring that the ball is aimed where intended. Ideally, when returning or "passing" the ball during play, the hands are held together, with the fingers entwined and the thumbs pressed together to form a flat surface on the outer palmar surface of the hands and a "platform" on the lower part or ventral side of the arms with which to hit or pass the ball. If the thumbs, arms, or body stance are not precisely positioned, the ball can bounce off the thumb-hand surface or the arm platform and go in the wrong, or a less than ideal, direction. A precisely formed and directed platform will address the volleyball at a 90° angle, or dead straight on, so that the ball leaves the platform in a direction that is 90° relative to the platform. Players can spend hours practicing the correct stance, hand placement, arm placement and force necessary to properly return or place a ball. While the slightest error in arm or hand placement can misdirect the ball, the error in form can be difficult to determine.

Players practice the technique of "hold on target," which is holding position for a short period after a ball is hit so ball direction and body stance can be correlated. This can also help develop the "muscle memory" necessary to repeat the proper form. Learning the muscle memory necessary to achieve the proper body placement during play can take hours of practice just hitting a ball and often finding the perfect form is the result of trial and error. There is no method or device that can indicate to a player immediately when his or her form is correct. Such a device or method would allow players to practice more efficiently and learn the muscle memory necessary to achieve the proper form for accurate ball placement during play.

There are devices and garments available that can be worn on one or both of the arms to provide protection during practice. Some of these even have targets on them that can help players learn where to contact the ball with the arms. But, these may not be adequate for teaching formation of a proper platform and body stance. Current practice techniques and devices still require players to spend hours hitting a ball in order to improve their skill.

BRIEF SUMMARY

The devices and methods of the subject invention make it possible for volleyball players to practice efficiently and quickly develop the proper body form and skill necessary to achieve accurate and consistent ball placement. Embodiments of a practice apparatus can create or trigger one or more visual or audible indicators that show a player whether their stance and form will result in the desired ball trajectory and placement. A practice apparatus can be used anywhere to teach the formation of a proper service "platform." The one or more visual or audible indicators provided by the practice apparatus can show a player where a ball will be directed based upon the platform formation, stance, position relative to the ball, and other factors that can affect ball trajectory and placement. Embodiments of a practice apparatus successfully address the above described disadvantages associated with previously known devices and methods and provide certain attributes and advantages, that have not been realized by these known devices. The subject invention provides novel, inexpensive, and highly effective devices and methods for quickly learning and practicing proper body form, so as achieve consistent, accurate ball placement, without having to hit or in conjunction with hitting, a ball.

In one embodiment, a practice apparatus emits at least one audible, visual, or other type of indicator that is discernable to a player. A practice apparatus can include a signal emitter and a target. In a further embodiment, a practice apparatus includes a signal receiver that can be utilized or incorporated with the target. A signal created by the signal emitter can project to a target some distance from the player. In one embodiment, the indicator is visual so a player can see whether the target was hit. In another embodiment, the indicator is audible so a player can hear whether the target was hit. In still another embodiment, both a visual and an audible indicator are provided to a player. In a particular embodiment, a signal receiver is utilized, either in close proximity to or incorporated with, the target. The signal transmitter and signal receiver can be used together to determine when an audible and/or visible indicator should be triggered. For example, a volleyball player can form a platform with the arms while assuming a body stance and aim at a target. This can cause the signal transmitter to also be aimed at the target. If the aim is true, the player can receive at least one of a visual, audible, or haptic indicator This allows the player to adjust the arms, body, hand placement, or any other aspect of their body stance and immediately realize how the changes would affect ball placement if they were to hit the ball in that position or stance.

Thus, utilizing the practice apparatus of the subject invention, a player can practice the proper body stance necessary to achieve the desired ball placement without having to repeatedly hit a ball and the player can get practically immediate feedback from the audible or visual indicator as to how changes in stance and position will effect ball placement. This allows the player to learn the position or body stance they have to achieve for desired ball placement, allowing them to practice that position and stance more effectively, repeatedly, and to more quickly obtain the muscle memory to instinctively achieve that desired body stance during play.

Further embodiments include the practice apparatus as part of a training system. In certain embodiments, instructions, practice drills, and other information can be provided that inform a player how to utilize the practice apparatus to achieve more accuracy in ball placement. The drills can be provided as printed materials and/or in a digital format.

BRIEF DESCRIPTION OF DRAWINGS

In order that a more precise understanding of the above recited invention can be obtained, a more particular description of the invention briefly described above will be rendered by reference to specific embodiments thereof that are illustrated in the appended drawings. The drawings presented herein may not be drawn to scale and any reference to dimensions in the drawings or the following description is specific to the embodiments disclosed. Any variations of these dimensions that will allow the subject invention to function for its intended purpose are considered to be within the scope of the subject invention. Thus, understanding that these drawings depict only typical embodiments of the invention and are not therefore to be considered as limiting in scope, the invention will be described and explained with additional specificity and detail through the use of the accompanying drawings in which:

FIG. 1A is a top side plan view and FIG. 1B is a right side elevation view of this embodiment.

FIG. 2A is a top side plan view and FIG. 2B is a right side elevation view of this embodiment.

FIG. 3A is a top side plan view and FIG. 3B is a right side elevation view.

FIG. 5A is a partial view from the top side of the practice apparatus showing an internal placement for a signal emitter support. FIG. 5B illustrates an embodiment of a signal emitter support that can be used with embodiments of a practice apparatus. FIG. 5C illustrates one embodiment of a signal emitter that can be used with a signal emitter support.

FIG. 6A shows a player's arms inserted into the arm channel of a sleeve. FIG. 6B shows a player's arm with an adjustable band attached.

DETAILED DISCLOSURE

Figure 1A:
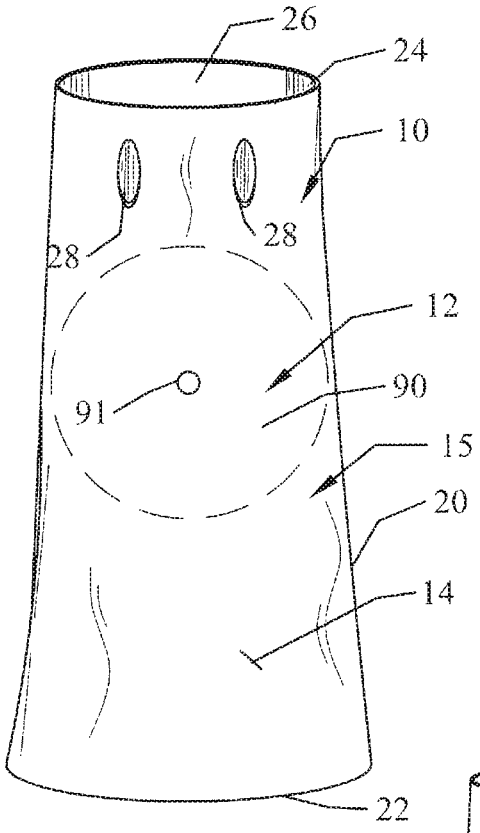
FIGS. 1A and 1B illustrate one embodiment of a practice apparatus, according to the subject invention, utilizing a signal emitter in a sleeve having a single arm channel, where

The subject invention pertains to devices and systems for improving ball handling skills. More specifically, the subject invention provides one or more embodiments of a practice apparatus for use in training a proper positioning and holding of the arms and hands for making contact with a ball In particular embodiments, the subject invention is capable of providing or triggering one or more audio or visual signals that are indicative of whether a player's aim is true and is accurately directed at the target. The subject invention can be used to train players in obtaining and practicing optimal body and arm position to achieve a desired ball trajectory to hit a target.

The subject invention is particularly useful for learning proper body, arm, and hand placement for striking a ball, in particular a volleyball. More specifically, the subject invention is particularly useful for the practice of volleyball placement and improving player skills. However, a person with skill in the art will be able to recognize numerous other uses for which the devices and methods of the subject invention could be applicable including a use for hitting a ball or other playing object with the feet, legs, and other part of the body. Thus, for literary convenience, the subject application describes, and many of the terms herein relate to, the game of volleyball. Modifications to the subject invention for other similar uses, such as for training for soccer, basketball, tennis, or similar activities, which would be apparent to a person with skill in the art having benefit of the subject disclosure, are contemplated to be within the scope of the present invention.

The term "target" as used herein is merely for literary convenience. A target can be an object, a person, or anything else at which the device of the subject invention can be directed to observe a visual indicator. A target can also be an area or direction as well. Thus, unless specifically described herein as such, a target does not have to be a specific device or object.

Finally, reference is made throughout the application to the "proximal end" and "distal end." As used herein, the proximal end is that end nearest to the elbow or shoulder of the player. Conversely, the distal end is that end furthest from the elbow or shoulder or closer to the hands or fingers of a player.

The present invention is more particularly described in the following examples that are intended to be illustrative only because numerous modifications and variations therein will be apparent to those skilled in the art. As used in the specification and in the claims, the singular for "a," "an" and "the" include plural referents unless the context clearly dictates otherwise.

Reference will also be made to the attached figures on which the same reference numerals are used throughout to indicate the same or similar components. With reference to the attached figures, it can be seen that embodiments of a practice apparatus 10 of the subject invention can include a signal emitter 50 with an attachment device 15 that can be used to secure the signal emitter 50 to a limb, such as an arm, where the signal emitter can project a signal 80 that activate, triggers, or otherwise cause to be seen, felt, or heard an indicator 70. There can also be a signal receiver 150 that can receive a signal from the signal emitter 50. The signal receiver can be used with or incorporated as part of a target 100. The location and position of the target can be stationary or moved so that different stances and positions can be practiced. A practice apparatus, which can include a signal emitter 10 and target 100, with or without a signal receiver 150, can be part of a training system 200. Each of these general components can have one or more sub-components, which will be discussed in detail below.

Figure 6A:
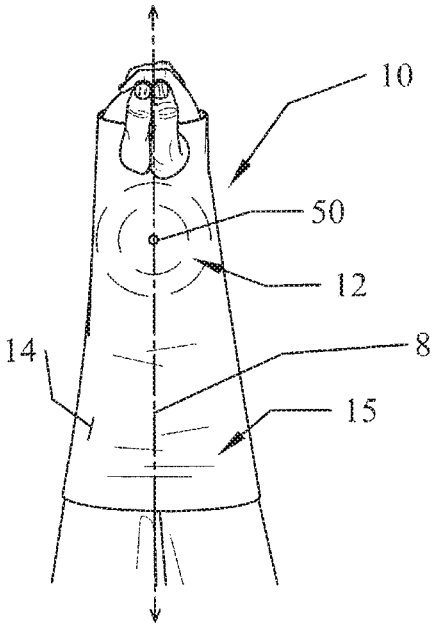
FIGS. 6A and 6B illustrate embodiments of an attachment device of a practice apparatus in use with a player's arms.

Embodiments of a practice apparatus 10 of the subject invention include an attachment device 20 for adjustably and operably connecting a signal emitter 50 to a player. In one embodiment, the attachment device is a dual-arm sleeve in which both arms, specifically the forearms, of a player can be inserted or placed. FIG. 6A illustrates a non-limiting embodiment of a player's arms inserted into an embodiment of a dual-arm sleeve. The dual-arm sleeve can hold the forearms together and substantially parallel to each other, which is the typical position used for contacting a volleyball. Ideally, the material of the dual-arm sleeve can be sufficiently flexible and elastic to accommodate different players and also to allow a player to adjust his or her arms in the dual-arm sleeve. In one embodiment, the entire dual-arm sleeve is elastic and flexible, so that it is entirely adjustable and conformable.

A dual-arm sleeve can also be of different longitudinal lengths 7, that is the distance between the distal end 3, near the hands, to the proximal end 5, near the elbow. Typically, the "platform" that is formed by a player for contacting a volleyball is located on what is anatomically referred to as the ventral forearm, which is between the outer palmar surface of the thumbs and the point of flexure at the elbow. Ideally, the platform is located on or about the center of the ventral forearms, which can provide a substantially flat surface and more accurate ball control. Thus, it can be beneficial for the dual-arm sleeve, when worn by a player, to extend from the thumbs to at least over the forearms.

Figure 1B:
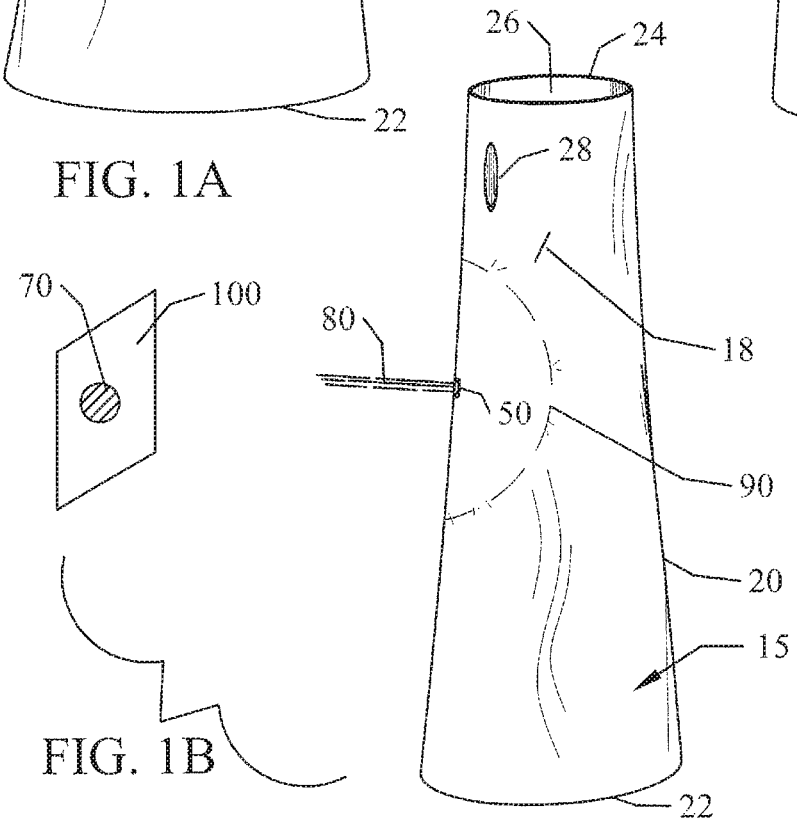

FIGS. 1A and 1B illustrate an embodiment of a dual-arm sleeve where the length of the dual-arm sleeve allows it to extend from the base of the thumb and go over the forearms, so that a platform area 12 can be formed on the top side 14 of the dual-arm sleeve. In one embodiment, the dual-arm sleeve can include thumb-holes 28 through which the thumbs can be inserted to help hold the sleeve in place. In one embodiment, the longitudinal length 7 of the dual-arm sleeve is between approximately 8 inches and approximately 18 inches. In a more particular embodiment, the longitudinal length of the dual-arm sleeve is between approximately 10 inches and approximately 14 inches. In a specific embodiment, the longitudinal length of the dual arm sleeve is approximately 12 inches.

Figure 2A:
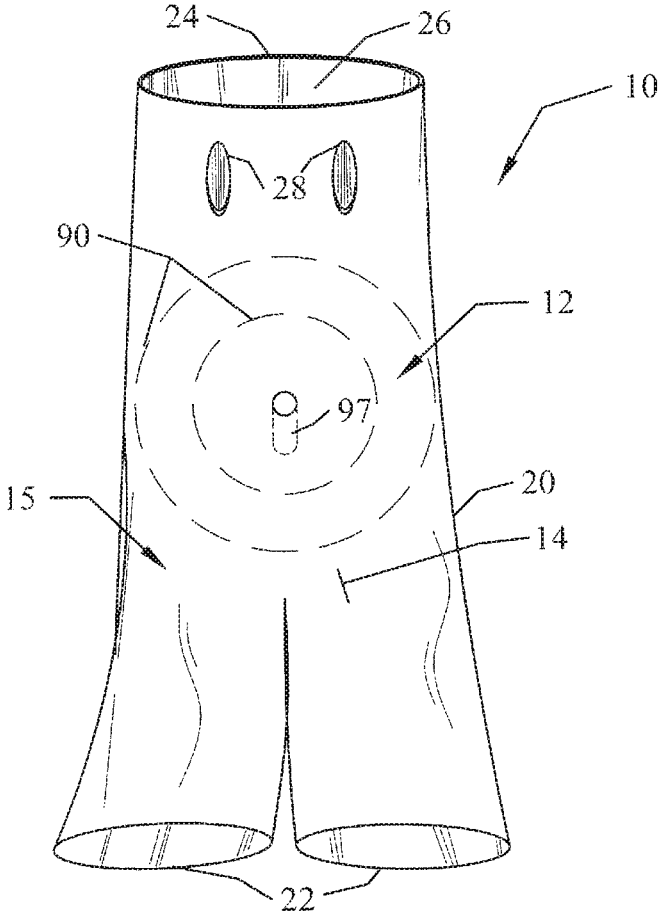
FIGS. 2A and 2B illustrate another embodiment of a practice apparatus, according to the subject invention, utilizing a signal emitter in a sleeve having a single arm channel that bifurcates towards the proximal end to form two arm channels.
Figure 2B:
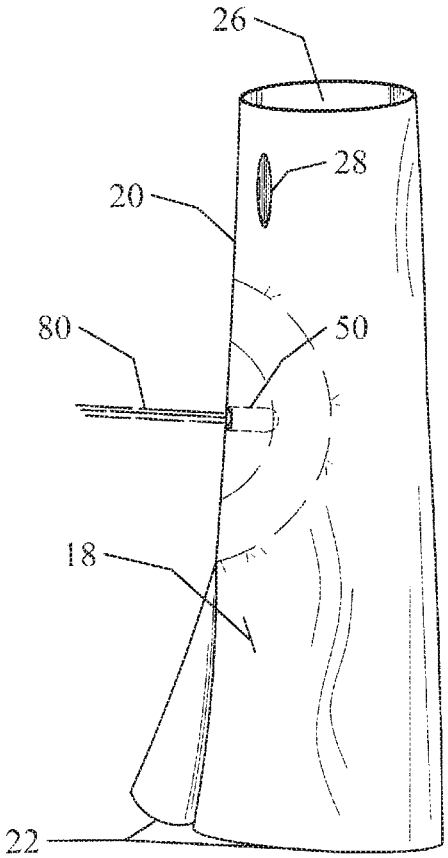
Figure 3A:
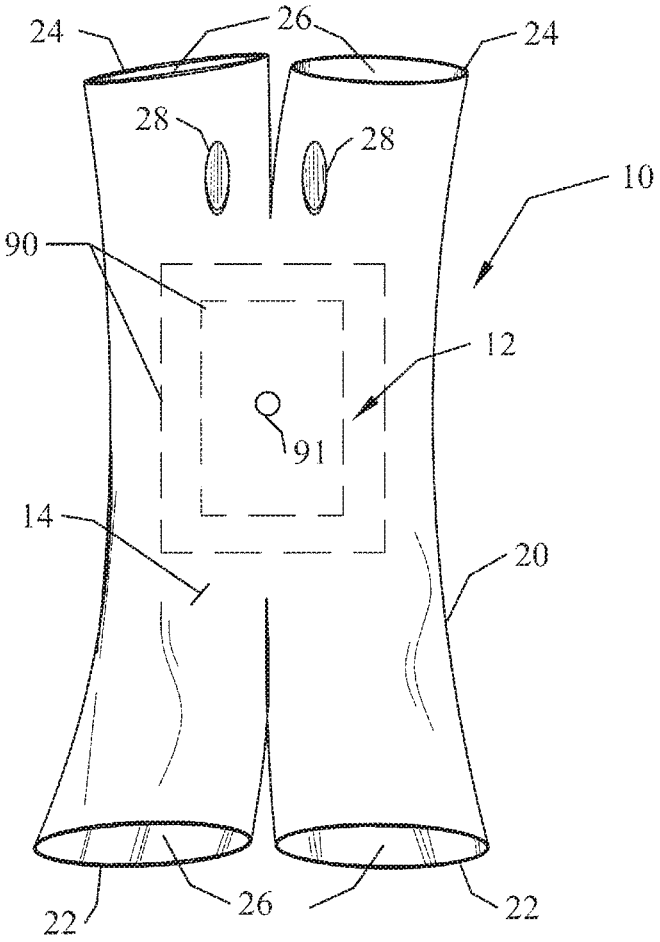
FIGS. 3A and 3B illustrate yet another embodiment of a practice apparatus, according to the subject invention, utilizing a signal emitter in a sleeve, where a portion of the proximal end of the sleeve is bifurcated to form two arm channels and a portion of the distal end is bifurcated to form two arm channels and the portion therebetween is formed as a single arm channel.
Figure 3B:
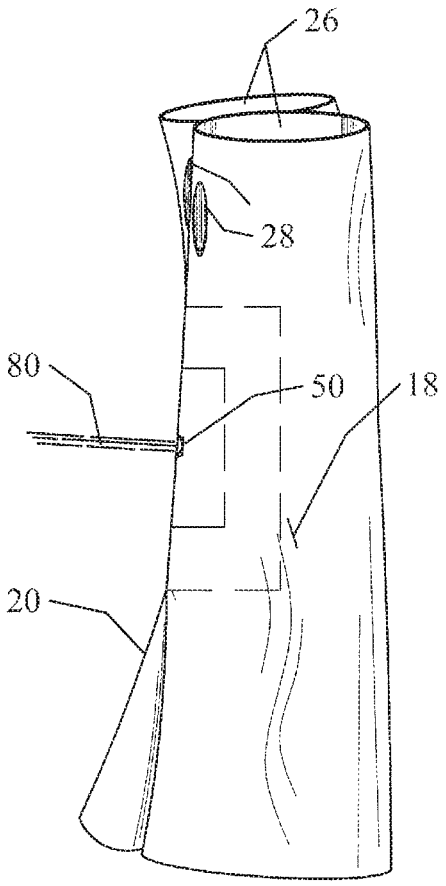

In one embodiment, the practice device 10 has a dual-arm sleeve 20 that is a tubular construction with at least one proximal end opening 22 and at least one distal end opening 24, with an arm channel 26 therebetween. FIGS. 1A and 1B illustrate a non-limiting example of this embodiment. In another embodiment, the dual-arm sleeve is bifurcated at or near the proximal end, so that there are two proximal end openings 22 and one distal end opening. One example of this is shown in FIGS. 2A and 2B. In yet another embodiment, the dual arm sleeve is bifurcated at both ends, such that there are two proximal end openings 22 and two distal end openings 24. An example of this embodiment is shown in FIGS. 3A and 3B.

With each of these dual-arm sleeve embodiments, the proximal and distal end openings lead into a single arm channel 26, where at least some part of the arms can be in direct contact when positioned in the dual arm sleeve. Alternatively, the dual-arm sleeve can be bifurcated along all or most of longitudinal length 7, such that there are two, separated arm channels 26 and the arms of a player have minimal or no contact when inside the practice apparatus.

Figure 4:
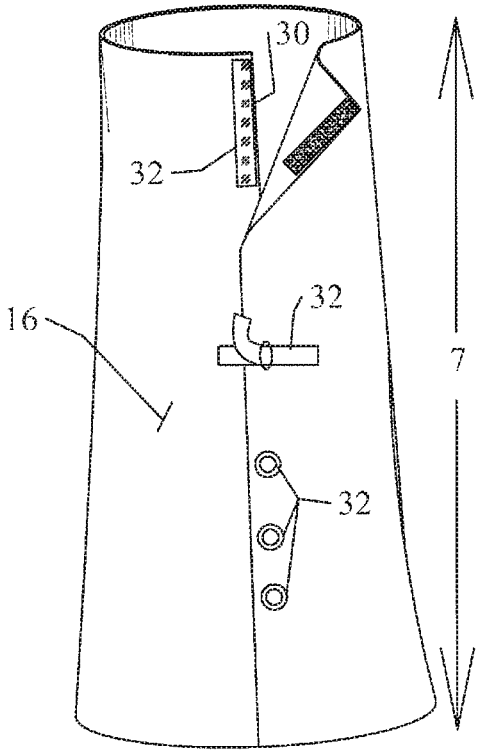
FIG. 4 is a back side plan view of an embodiment of a practice apparatus, according to the subject invention, utilizing a signal emitter in a sleeve having a closable longitudinal slit from the distal end opening to the proximal end opening. Also illustrated are examples of closure devices, including hook-and-loop material, buckles, and snaps that can be used to close the longitudinal slit.

In an alternative embodiment, a dual-arm sleeve can have a longitudinal slit 30 that allows all or part of the dual-arm sleeve to be laid open. One non-limiting example of a longitudinal slit is shown in FIG. 4. Also shown in FIG. 4 are examples of closure apparatuses 32 that can be used to close and secure the longitudinal slit, including, but not exclusive to, hook-and-loop material, buckles, snaps, and ties. A longitudinal slit can be located anywhere on a dual-arm sleeve. FIG. 4 shows an embodiment where the longitudinal slit is located on the bottom or ventral side 16 of the dual arm sleeve. A longitudinal slit can also be located on one side 18. There can also be more than one longitudinal slit.

Figure 6B:
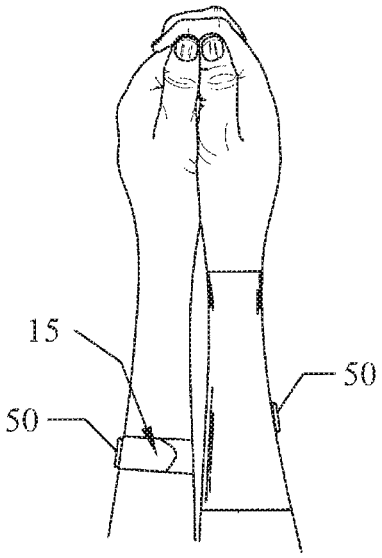

An alternative embodiment of an attachment device 20 is an adjustable band that can circumscribe some portion of an arm of a player. A signal emitter 50 can be operably connected to the adjustable band. FIG. 6B shows two non-limiting examples of adjustable bands on a player's arm with signal emitters attached.

An adjustable band can be an object or material that can wrap around the arm and, preferably, maintain position on the arm. Preferably, an adjustable band can hold the signal transmitter in a position for aiming at the target and/or a signal receiver 150. An adjustable band can also have any of a variety of mechanisms for adjusting the size or circumference of the band. For example, hook and loop material, buckles, buttons, snaps, hooks, other similar mechanisms or combinations thereof can be used. Alternatively, the adjustable band can have shape-memory characteristics that allow it to be stretched to fit around an arm and can retract to conform to the shape of the arm. A person with skill in the art will be able to configure an adjustable band suitable for use in securing a signal transmitter to a player.

Once an attachment device 20 is operably connected to one or both arms of a player, as shown, by way of example, in FIGS. 6A and 6B, the player can practice the arm position and body stance required to achieve the desired ball placement. During active play, players are moving around the court as they contact the ball. Players train so as to instinctively know how to position their arms and body to contact the ball regardless of where it and they are located on the court. In other words, they know how to position their arms, in any body stance, to achieve a platform position with their arms that will put the ball on target. Extensive practice hitting a ball and observing the results have been, until now, the only method by which players could improve skill.

The practice apparatus of the subject invention can improve a player's ability to instinctively adjust their body stance and can facilitate the development of muscle memory for more accurate ball placement. Providing a visual indicator 70 allows a player to see how changes in body stance affect their platform formation, position, direction, and ultimately the ball placement. With an indicator provided by the embodiments of the subject invention, a player can practice ball placement from any position without ever having to actually make contact with a volleyball. The player can easily observe how a body stance needs to be adjusted in order to place the ball where desired. Advantageously, the embodiments of the subject invention allow a player to practice anywhere, on or off the court.

An indicator 70 can be any observable or otherwise detectable phenomenon that can be visually or audibly discerned by a player. In one embodiment, an indicator is a beam of light that is incident on a designated target 100. In another embodiment, an indicator is a noise or sound that can be heard by the player. In another embodiment, an indicator is an object that changes position, location, shape, or some other observable manner. For example, an object on or near the target could move. In yet another embodiment, an indicator is some change to the condition of the target. For example, the target could glow or shine. In still another embodiment, an indictor can be sound that is emitted when a signal contacts the target. In yet another embodiment, an indicator is a combination of observable phenomenon, such as, for example, a light combined with a change in the position of the target or, in another example, a visual or audible indicator can be emitted when one or more signals reaches the target.

There could also be other player discernable indicators associated with the indicator, such as, for example, haptics associated with a sound or light indicator. When the indicator is in a particular location or position, a there can be a vibration in a component of the practice apparatus that the player can feel. In one embodiment, the signal emitter has a vibrator mechanism, which is known in the art, that can be triggered and felt by a player.

One embodiment of the subject invention employs a signal emitter 50 incorporated with the attachment device 20. As used herein, a signal 80 can be any type of transmission that creates, triggers, or otherwise causes to be presented a visual, haptic, or audio indicator 70. The indicator can inform a player, wearing a signal emitter, according to the subject invention, where a volleyball will be directed when the player assumes a specific body stance and platform. In one embodiment, the indicator is seen on the target 100, such that the player can observe a light, point of light, or some other visual indicator on the target 100.

In one embodiment, a signal emitter 50 transmits an electrical or electromagnetic sign to a signal receiver that creates the visual indicator on the target. In an alternative embodiment, a signal emitter 50 transmits a signal 80 that it is received by a sensor 155 incorporated with the signal receiver 150 when the signal is directed at the target, so that the signal receiver emits a sound or instigates a visual que that indicates that it received the signal 80. In another alternative embodiment, a signal emitter 50 transmits a signal 80 that is received by a sensor 155 incorporated with the signal receiver 150 when the signal is directed at the target, which prompts components 157 in the signal receiver to send a return signal 85 to the signal transmitter, thereby causing a sound, visual event, haptic response, or some combination thereof observable by the player. In another embodiment, a signal emitter transmits a signal to a signal receiver that creates the visual indicator on the target. In yet another embodiment, a signal emitter transmits a visible beam of light that can be directed at and seen on a target. In a specific embodiment, a signal emitter produces a laser beam light that can be directed at and seen on the target. There are a variety of combinations of signals and indicators that can be configured for the purposes of informing a player when a target has been reached or contacted by the signal. Such variations are within the scope of this invention.

As described above, a signal emitter 50 can be used to produce, or cause to be produced, some type of indicator that informs a player whether their assumed body position and the platform area 12 on the dual-arm sleeve or the platform formation on their arms will result in the ball being directed at a target 100. For purposes of consistency and accuracy, when practicing volleyball play, it can be beneficial for a platform to hit the volleyball at a 90° angle, such that the volleyball also moves directly away from the platform area at a 90° angle. Thus, players learn to adjust body stance so that the platform of their arms always strikes 90° to the volleyball. As such, it can be advantageous for the signal emitter 50 to be directed from the practice device 10, so that the visual indicator 70 produced can show a player when the platform area is directed 90° to the volleyball.

A signal emitter can be located anywhere on an attachment device, as long as the signal 80 can be directed towards a target, as described above. In one embodiment, on a dual arm sleeve 21, the signal emitter is located along a longitudinal medial line 8, so that it is positioned somewhere between the arms of the player and directs the signal 80 out from the top side 14 of the practice device 10, as illustrated, for example, in FIGS. 1B, 2B, and 3B. In a more particular embodiment, the signal emitter 50 is located so that it directs a signal 80 out from the platform area 12, as shown, for example, in FIGS. 1A, 5A and 7. In a specific embodiment, the signal emitter 50 is emplaced along the longitudinal medial line 8 and is centered within the platform area so that a signal 80 is emitted at a 90° angle directly out from the platform area.

A multitude of devices and apparatuses can be used for a signal emitter 50 with the embodiments of the subject invention. Preferably the signal is tightly focused so that an indicator is provided when the signal is precisely aimed. By way of non-limiting example, a signal emitter can have components that emit or transmittightly focused light, radio waves, infrared signals, electromagnetic pulses, or any analog or digital signal. The type of signal emitter utilized can dictate how it is secured to the attachment device. By way of non-limiting example, a dual-sleeve attachment device can include a support 90 to which the signal emitter can be secured. Preferably, such a support will cause the signal 80 from the signal emitter 50 to be directed 90° to the platform area 12 when the player's arms are arranged to form a flat platform surface. Thus, the signal can assist a player in forming a proper arm platform, as well as learning how to address the ball with the platform. The dual-arm sleeve can include an eyelet 91 through which the signal emitter can transmit.

In one embodiment, a support 90 is a layer, or multiple layers, of padding within the area in which the platform area 12 is formed. The padding can have some flexibility for comfort, but be sufficiently thick so that it can support a signal emitter. The padding can be any suitable material, such as, but not limited to, foam, leather, cloth, vinyl, some combination thereof, or other pliable or flexible material. Further, the padding can extend at least partially over the arms when the practice device is worn. If the player's arms are not aligned in a fashion that forms an adequate platform area 12, the signal 80 will be misdirected, so that it is not directed 90° from the platform area. This can be an indication to a player that the position of the arms needs to be adjusted. FIGS. 1A, 2A, and 3A illustrate a platform area 12 on embodiments of a practice device in which support padding has been secured within the arm channel. In FIG. 1A, there is a single layer or thickness of padding. In FIG. 2A, there is shown two layers or thicknesses of padding. FIG. 3A shows an alternative configuration for the padding that is rectangular or square.

Figure 5B:
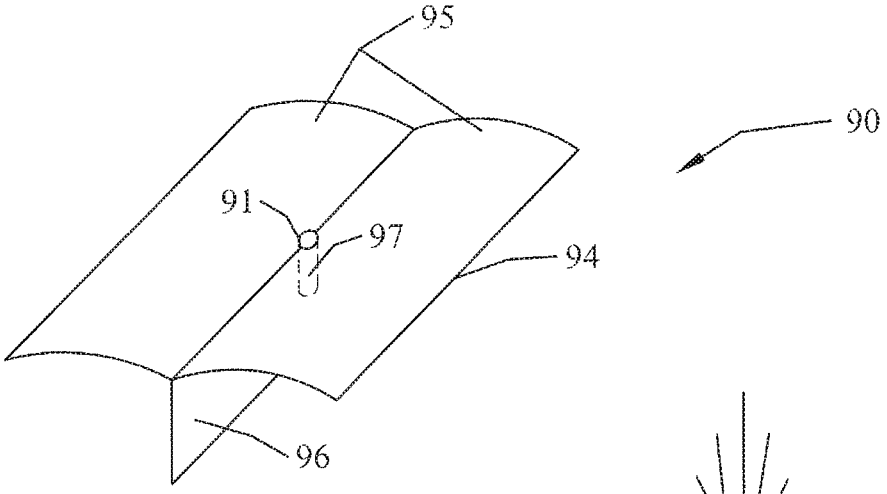
FIGS. 5A, 5B, and 5C illustrate one embodiment of a signal emitter support.
Figure 5C:
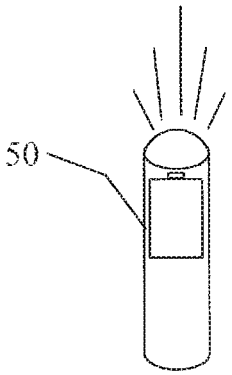
Figure 5A:
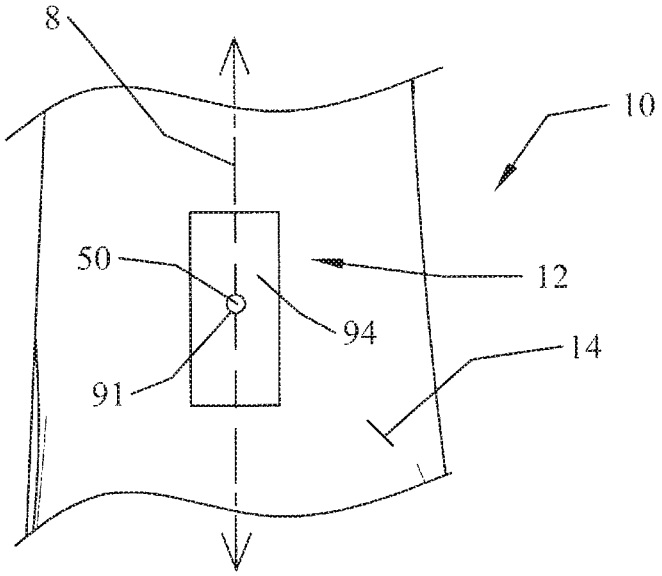

In another embodiment, a support 90 is a rigid frame 94 located in the area in which the platform area 12 is formed. The rigid frame can have a "T-shape" with two curved wings 95 that curve over and can be supported on the arms and at least one leg 96 central to the wings that protrudes down between the arms when the practice device is worn. The wings 95 and the at least one leg 96 can help support and maintain the position of the rigid frame. As with the above-described padding support, if the player's arms are not aligned in a fashion that forms an adequate platform on the arms, the signal 80 will be misdirected, so that it is not directed 90° from the platform area 12 on the dual-arm sleeve. This can be an indication to a player that they need to adjust their arms. FIG. 5B illustrates one non-limiting example of a rigid frame embodiment. Further, a signal emitter 50 can be secured within a seat 97, such as, by way of non-limiting example, a bore, slot, channel, pouch, cage, or other space formed within the rigid frame. In a particular embodiment, shown in the example in FIGS. 2A and 5B, there is a seat 97 between the wings that extends down towards a leg in which a signal emitter, such as, for example, a laser pointer device, can be secured. FIG. 5C illustrates one example of a signal emitter 50 that is a tubular laser light pointer device that can fit into a seat in a rigid frame.

In an alternative embodiment, the leg 96 can be minimal or non-existent and there can be only a seat 97 extending from the wings and down between the arms. With this embodiment, it can be advantageous for the seat to be secured to the wings and/or the arms, so that it can maintain the desired 90° signal direction from the platform. A person with skill in the art will be able to determine an appropriate seat for the type of signal emitter that is used. Such variations are within the scope of this invention.

Figure 8:
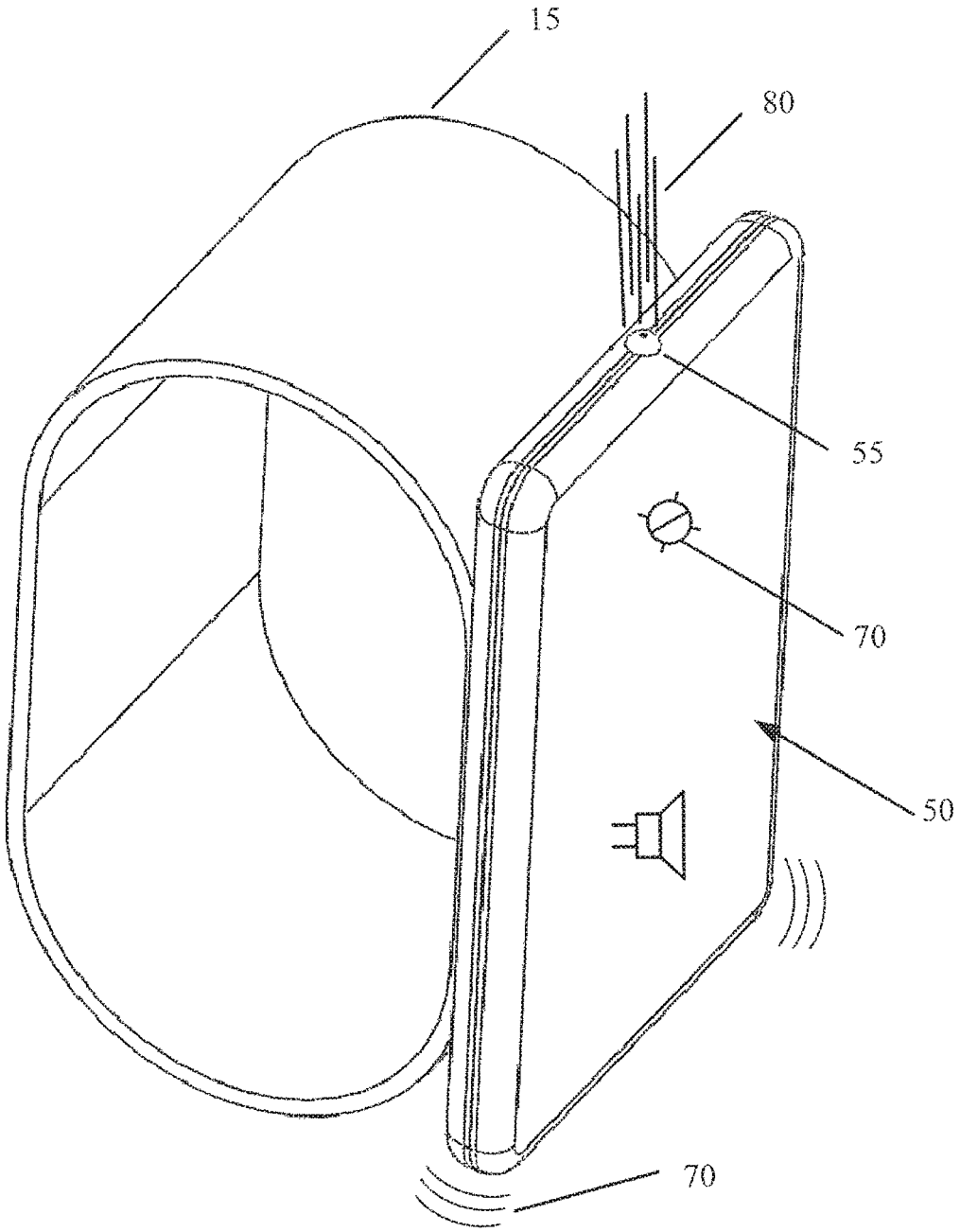
FIG. 8 is an illustration of an embodiment of a signal transmitter, according to the subject invention.
Figure 9:
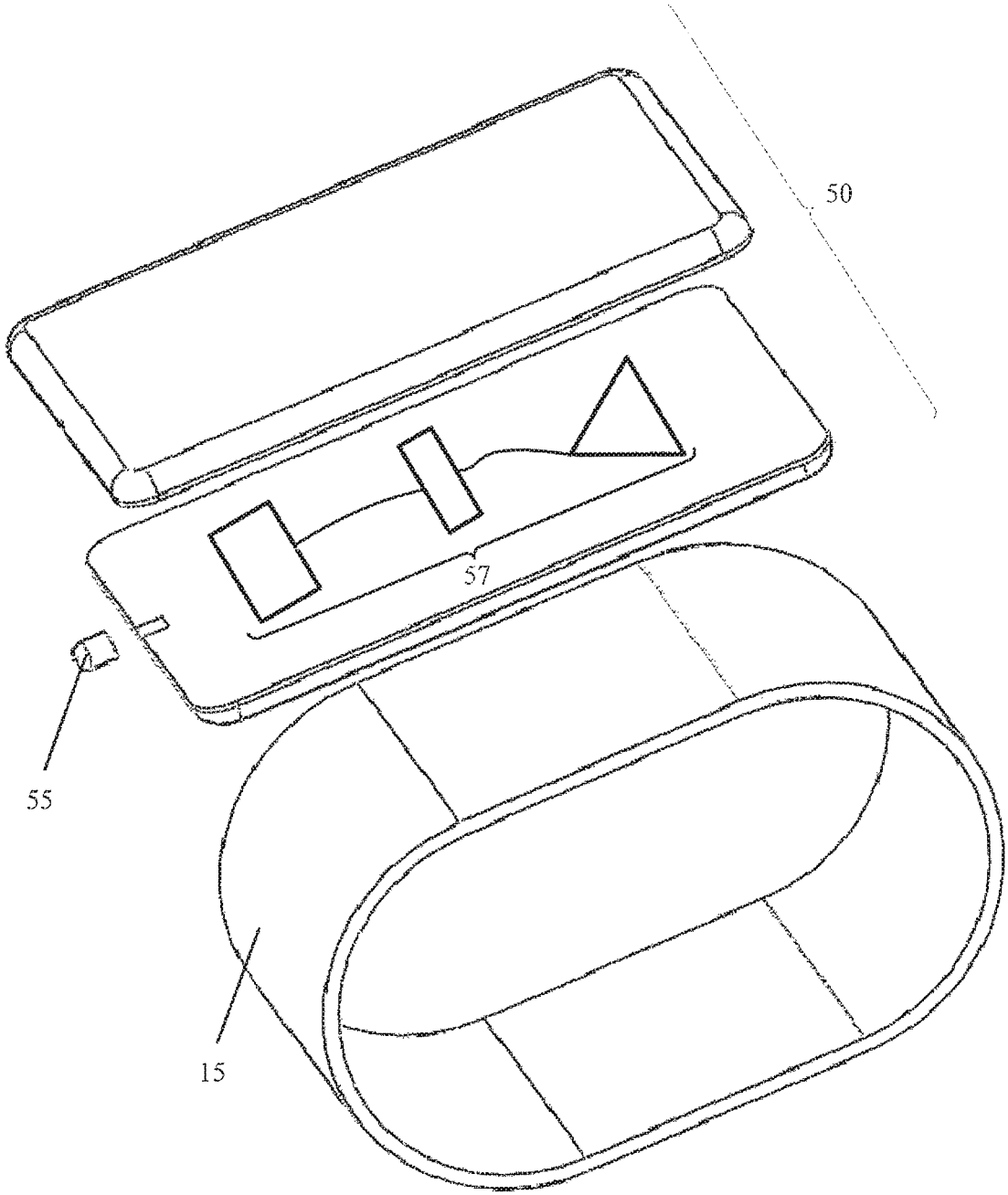
FIG. 9 is an exploded view of the embodiment of a signal transmitter in FIG. 8.
Figure 10:
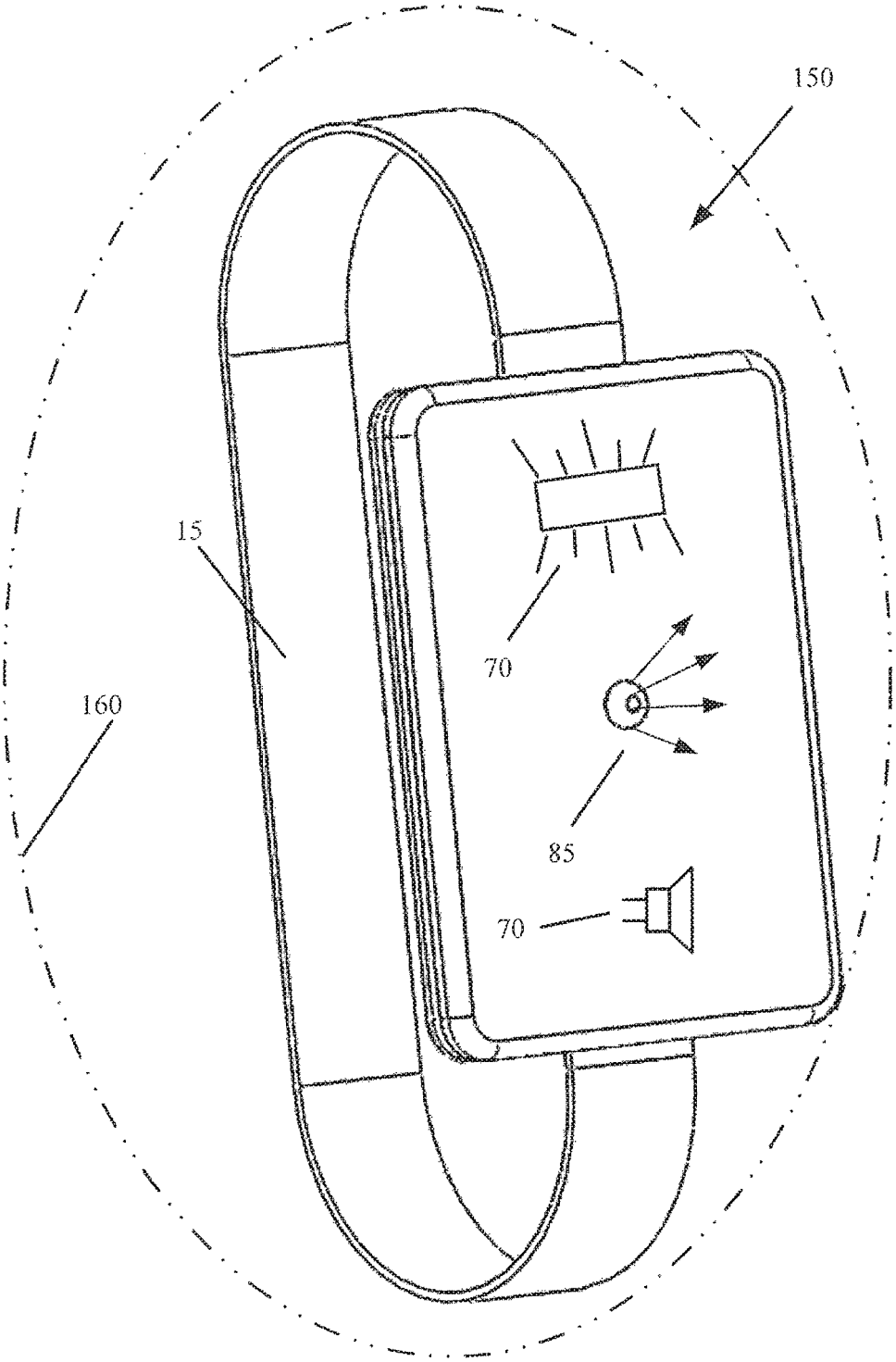
FIG. 10 is an illustration of an embodiment of a signal receiver, according to the subject invention.
Figure 11:
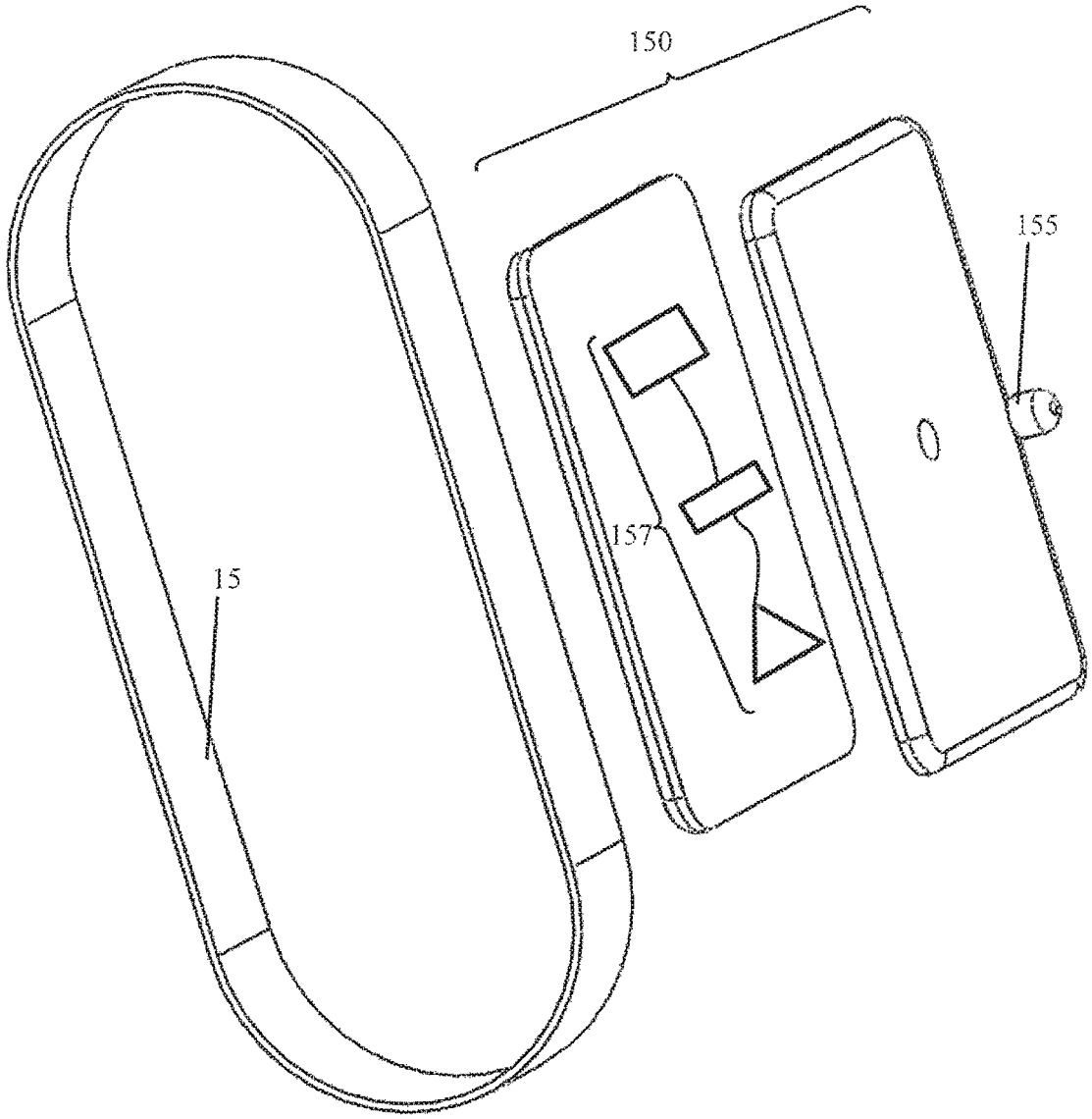
FIG. 11 is an exploded view of the embodiment of a signal receiver in FIG. 10.

In a particular embodiment, a practice apparatus includes a signal emitter 50, such as shown, for example, in FIG. 8, with an infrared (IR) transmitter 55, and a signal receiver 150, such as shown, for example, in FIG. 10, with an infrared (IR) sensor 155. Both the IR transmitter 55 and the IR sensor 155 can be configured with narrow or tight operating ranges, so that the IR transmitter transmits a tightly focused or narrow beam IR signal and the IR sensor receives IR signals within a tight, prescribed range or radius 160 around the IR receiver 155. This can ensure that an indicator will only be triggered and presented to a player when the beam of the IR signal 80 is within a specifically determined, prescribed, and precise radius 160, which can occur when the player aims the signal transmitter in the correct direction. In other words, the player must accurately aim the beam of the IR signal within the pre-determined radius of the IR receiver in order to trigger the indicator. FIG. 10 illustrates a non-limiting example of a radius around a signal receiver. In one embodiment, the radius is between approximately 3 inches and approximately 2 ft. In another embodiment, the radius is between approximately 4 inches and 18 inches. In, a more particular embodiment, the radius is between approximately 6 inches and 12 inches.

Utilizing the practicing apparatus of the subject invention as part of a training system 200, the skill of a player will improve, such that ball placement will be more precise. In a further embodiment, the radius 160 can be adjusted to accommodate the skill of a player. Thus, the radius may be increased for a beginning player and may be decreased as the skill of the player improves, so that more precise ball placement can be practiced.

The IR signal emitter 50 can be affixed to a player with an attachment device 15. In one embodiment, the IR signal emitter directs the IR signal 80 towards the fingers of the player wearing the attachment device. The IR signal receiver 150 can also have an attachment device 15 that allows it to be affixed to a target. In one embodiment, when the practice apparatus 10 is in use, the IR signal receiver is in constant "on" mode, so as to receive an IR signal from the IR signal emitter whenever it is directed towards the IR signal receiver.

Figure 12:
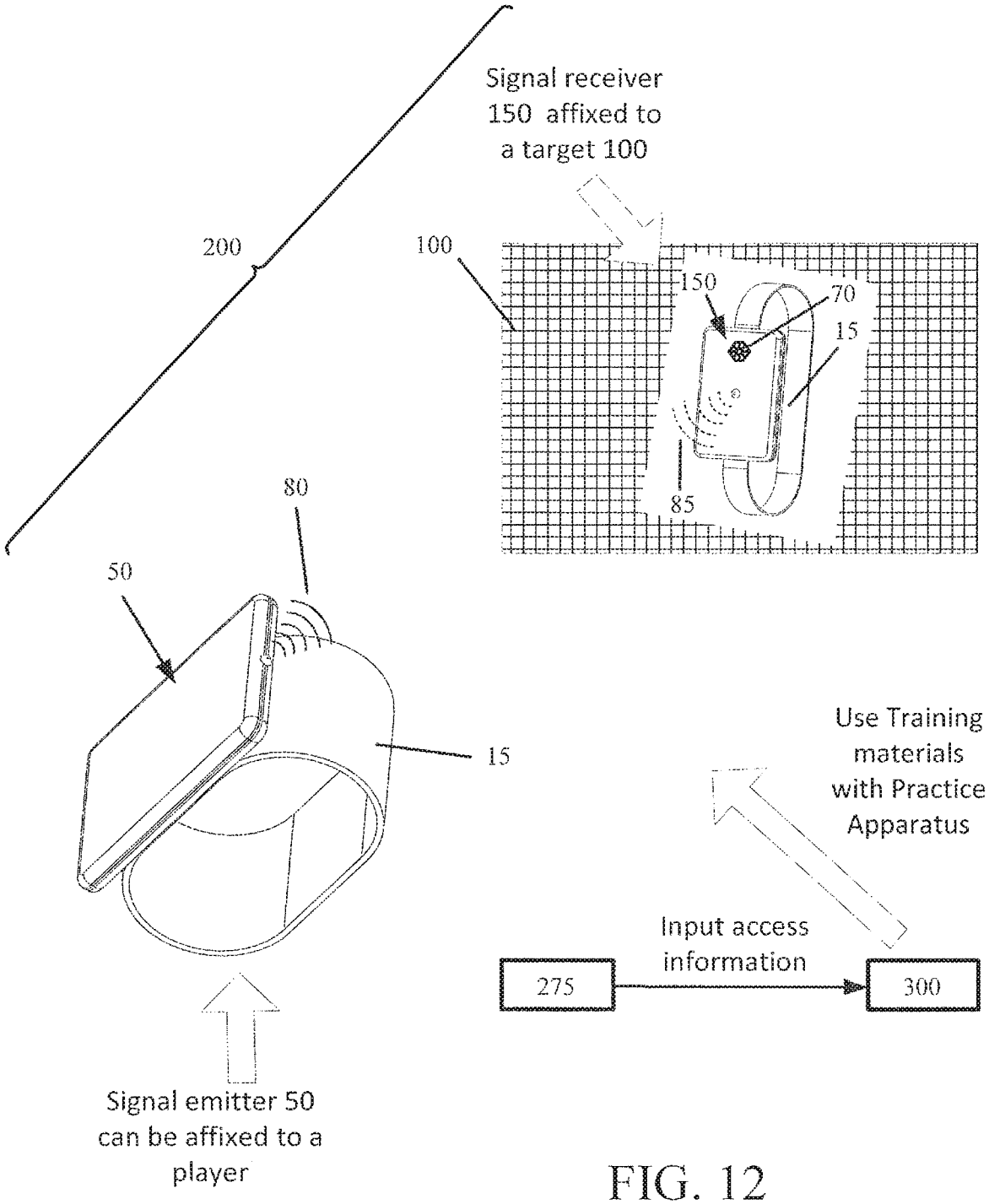
FIG. 12 illustrates a specific embodiment of a practice apparatus that utilizes an infrared signal.

In a further embodiment, the IR sensor 155 of the IR receiver 150 has an operable connection with one or more components 157, known to those with skill in the art, that receive the received IR signal 80. The one or more components can interpret the IR signal and generate a return signal 85 to the IR signal emitter 50. Likewise, the IR emitter has an operable connection with one or more indicator-generating components 57, which are known to those skilled the art. When the one or more indicator-generating components receive the return signal 158 there is generated an indicator 70 observable by the player. FIG. 12 illustrates a non-limiting example of this type of practice apparatus utilizing IR signals.

A practice device 10 embodiment of the subject invention can be incorporated as part of a training system 200. The training system can include a target 100 specifically designed to be used with a practice apparatus. The practice apparatus can include at least a signal emitter 50 and a target. The practice apparatus can additionally include a signal receiver 150 that can be used as a target or can be employed therewith. In one embodiment, the target is adjustable so that the training system can be used to practice multiple body stances and ball placements. In a specific embodiment, the target is mounted on an adjustable base 210. In a more specific embodiment, the target is a volleyball or a facsimile thereof mounted or securable on an adjustable height pole 220, such as a telescoping pole.

Figure 7:
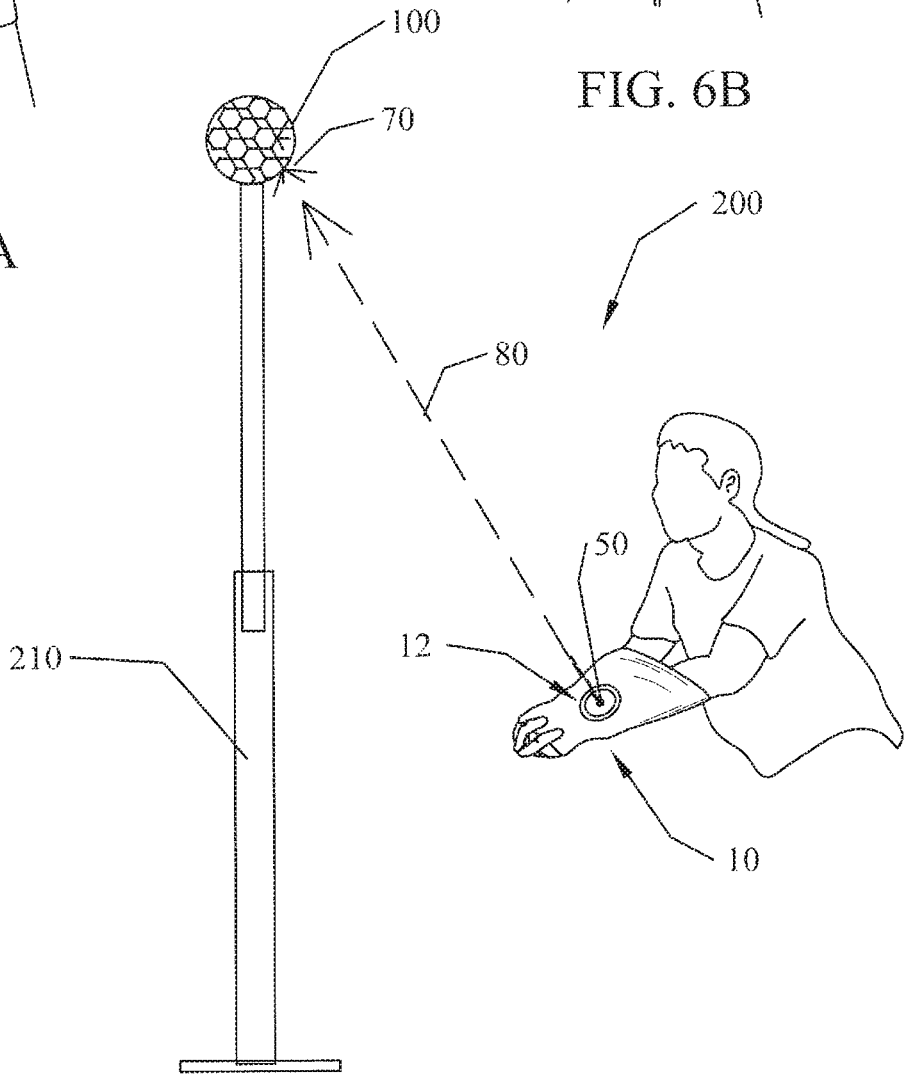
FIG. 7 is an illustration of one embodiment of a volleyball training system that incorporates a practice apparatus, according to the subject invention, having a light emitting visual indicator used with the target, here shown to be a volley ball. In this embodiment, the volley ball is attached to an adjustable base that is a telescoping pole for height adjustment.

FIG. 7 illustrates a non-limiting example of a training system 200 utilizing a practice apparatus having a target 100 with a signal emitter, according to the subject invention. In further embodiment, the signal emitter can be changeable or adjustable so that the indicator changes. For example, if the signal 80 is a light, the color can be changed. For another example, if the signal emitter is a radio signal, the frequency could be changed to produce a different effect on the visual indicator.

FIG. 12 illustrates another non-limiting example of a training system 200 utilizing a practice apparatus that includes a target 100, a signal emitter 50, and a signal receiver 150. As shown in this example, the signal emitter transmits a signal 80 to the signal receiver attached to a playing net. The signal 80 reaches the signal receiver, which triggers a return signal 85 to the signal emitter. It could also trigger an indicator on the signal receiver. The return signal received by the signal emitter triggers one or more indicators on the signal emitter.

In conjunction with a training system 200, training materials 300 can also be provided that utilize an embodiment of a practice apparatus. Embodiments of the training materials include instructions, practice drills, suggested body stances, and other information that can inform a player how to utilize the practice apparatus to achieve more accuracy in ball placement. The format of the training materials can be provided as printed materials and/or in a digital format. In a specific embodiment, a practice apparatus includes access information 275 that allows access to proprietary training materials. The access information can be, for example, a digitally input code used at a specific on-line location, such as a website, that provides access to videos, publications, pictures, sounds, or any other type of information that can be used in tandem with or in conjunction with embodiments of a practice apparatus.

Following is an example that illustrates a practice apparatus and procedures for utilizing it according to the subject invention. This example is provided for the purpose of illustration only and should not be construed as limiting. Thus, any and all variations that become evident as a result of the teachings herein or from the following example are contemplated to be within the scope of the present invention.

Example: Practice Apparatus Using Infrared Signals for Practicing VolleyBall Skills Component 1: Infrared Transmitter Unit with Armband (One example in FIG. 8)

- 6061 Aluminum Case/Body, 2 halves mated by 4 screws (1 in each corner)
- Adjustable Arm Band
- Internal circuit board connected to infrared transmitter (battery powered)
- Removable battery cover Component 2: Infrared Receiver Unit with Attachment Strap (Example in FIG. 10)

- 6061 Aluminum Case/Body, 2 halves mated by 4 screws (1 in each corner)
- Attachment strap for attachment to target
- Internal circuit board connected to audible alarm and infrared receiver. Infrared
- receiver receives from infrared transmitter to sound alarm (battery powered)
- Removable battery cover Optional Components:

- Tripod mount for Infrared Receiver Unit for mounting to standard tripod base (which allows target to be relocated for different/additional training options)
- Adjustable rmband for Infrared Receiver Unit to allow second/receiving player to wear receiver unit (to allow moving target as opposed to stationary mounting on tripod or net)

Operation and Procedures:

Passing player wears Infrared Transmitter Unit on outside of forearm, with infrared transmitter facing forward (toward player's fingertips). Infrared Receiver Unit is strapped to target, such as the playing net; mounted to tripod; or worn by a receiving player, with infrared receiver facing in direction of transmitter. When both units are powered on, the transmitter unit will continuously transmit infrared beam, and the receiver unit will continuously remain open to receive infrared signal from transmitter unit. Upon receipt of infrared signal from transmitting unit, receiving unit will sound audible alarm (about a 1 second beep) to indicate that infrared signal was on target. If no audible alarm is heard, attempt was off target.

For almost any sport, player skill is improved with practice. Practice is usually a process of trial and error during which the player learns what works and what does not work for a given situation. The ability to practice more efficiently and effectively can reduce the amount of time that it takes a player to improve their skill. The embodiments of the subject invention provide devices and methods whereby a volleyball player can increase the efficiency and effectiveness of their practice. The devices can provide a player with immediate feedback about their arm position and body stance. When utilized with a target the devices can help develop specific skills and muscle memory necessary to react instinctively and quickly to achieve the desired ball placement.

The examples and embodiments described herein are for illustrative purposes only and that various modifications or changes in light thereof will be suggested to persons skilled in the art and are to be included within the spirit and purview of this application.

Any reference in this specification to "one embodiment," "an embodiment," "example embodiment," "further embodiment," "alternative embodiment," etc., is for literary convenience. The implication is that any particular feature, structure, or characteristic described in connection with such an embodiment is included in at least one embodiment of the invention. The appearance of such phrases in various places in the specification does not necessarily refer to the same embodiment. In addition, any elements or limitations of any invention or embodiment thereof disclosed herein can be combined with any and/or all other elements or limitations (individually or in any combination) or any other invention or embodiment thereof disclosed herein, and all such combinations are contemplated with the scope of the invention without limitation thereto.

We claim:

1. A training system comprising: a practice apparatus comprising, an attachment device configured to receive a first forearm and a second forearm, comprising: a tubular construct with a proximal end opening for receiving the first forearm and the second forearm and a distal end opening, such, that the tubular construct extends from a palmar surface of a thumb to at least over the first forearm and second forearm, which are held in close proximity within the tubular construct: two thumb-holes on a top-side of the tubular construct for each receiving a thumb when the first forearm and the second forearm are received in the tubular construct, so that the thumbs protrude from the top-side of the tubular construct, a platform area on the top-side of the tubular construct proximal to the thumb-holes: a signal emitter operably attached to the tubular construct in the platform area and having a transmitter capable of transmitting a focused signal; a signal receiver having a sensor capable of receiving the signal from the transmitter, where the sensor is operably connected to components that trigger at least one indicator when the signal is directed at the infrared sensor and wherein the sensor has a prescribed radius within which the signal is received; and such that, when the first forearm and the second forearm are received in the attachment device, the signal emitter, operably attached thereto, is in the platform area, so that the signal is aimed at the signal receiver from the platform area.

2. The training system, according to claim 1, wherein the components of the signal receiver provide a visual or audible indicator when the signal is received by the signal receiver.

3. The training system, according to claim 1, wherein the components of the signal receiver transmit a return signal to the signal emitter, and wherein the signal emitter further comprises components that provide at least one of a visual, audible, or haptic indicator when the return signal is received by the signal emitter.

4. The training system according to claim 1, wherein the infrared signal is directed at approximately 90° to the platform area on the top-side.

5. The training system according to claim 4, further comprising a support for operable attachment of the signal emitter.

6. The practice apparatus according to claim 1, further comprising a bifurcated proximal end with two proximal end openings for receiving the first forearm and the second forearm.

7. The training system, according to claim 1, wherein the signal transmitted by the signal emitter is at least one of an infrared, radio, light, electromagnetic, analog, and digital.

8. A practice apparatus comprising:

a signal emitter capable of transmitting a focused signal;

a signal receiver capable of receiving the signal from the signal emitter, wherein the signal receiver has components that trigger at least one indicator when the signal is aimed at the signal receiver, and wherein the signal receiver has a defined radius within which the signal is received; and an attachment device, configured to be affixed worn simultaneously over a first forearm and a second forearm, comprising two thumb-holes on a top-side of the attachment device, configured to receive two thumbs that protrude from the attachment device, and a signal emitter proximal to the thumb-holes and arranged on a top side of the attachment device to emit the signal from the top side.

9. The practice apparatus, according to claim 8, wherein the signal transmitted by the signal emitter is at least one of an infrared, radio, light, electromagnetic, analog, and digital.

10. The practice apparatus, according to claim 8, wherein the components of the signal receiver provide a visual or an audible indicator when the signal is received by the signal receiver.

11. The practice apparatus, according to claim 8, wherein the components of the signal receiver transmit a return signal to the signal emitter, and wherein the signal emitter further comprises components that provide at least one of a visual, audible, or haptic indicator when the return signal is received by the signal emitter.

12. The practice apparatus according to claim 8, wherein the signal is directed at approximately 90° to the top-side.

13. The practice apparatus according to claim 12, the attachment device further comprising a support for operable attachment of the signal emitter.

14. The practice apparatus according to claim 12, further comprising a bifurcated proximal end with two proximal end openings for receiving the first forearm and the second forearm.

15. A method for practicing playing skills, with a practice apparatus according to claim 8, comprising:

a. arranging the practice apparatus on the forearms so as to form a platform area on the top side, wherein
the signal emitter, is located between the arms to emit the signal from the platform area, and
the signal receiver is placed in proximity to a target;

b. directing the platform area at the signal receiver, so as to aim the focused signal at the defined radius of the signal receiver; and c. triggering the sensor of the signal receiver, so as to cause an indicator to be provided.

16. The method according to claim 15, wherein triggering the sensor causes the signal receiver to provide a visible or audible indicator.

17. The method, according to claim 15, wherein triggering the sensor causes the components of the signal receiver to transmit a return signal to the signal emitter, and wherein the signal emitter further comprises components that provide at least one of a visual, audible, or haptic indicator.

18. The method, according to claim 15, further comprising:

obtaining access information pertaining to the practice apparatus; and utilizing the access information to retrieve training materials usable in conjunction with the practice apparatus.

19. The method, according to claim 18, wherein the access information is obtained by acquiring the practice device and the training materials are obtained by inputting the access information at an on-line location.

20. The method according to claim 19, wherein the signal is directed at approximately 90° to the platform area formed on the top-side by the forearms of the player.

* * * * *